US006740801B2

(12) United States Patent
Yoshisue et al.

(10) Patent No.: US 6,740,801 B2
(45) Date of Patent: May 25, 2004

(54) ACTION FOR KEYBOARD-BASED MUSICAL INSTRUMENT

(75) Inventors: Kenji Yoshisue, Shizuoka-ken (JP); Yozo Koyama, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 10/161,612

(22) Filed: Jun. 5, 2002

(65) Prior Publication Data

US 2002/0189422 A1 Dec. 19, 2002

(30) Foreign Application Priority Data

Jun. 19, 2001 (JP) ..... 2001-185499

(51) Int. Cl.[7] ..... G10D 3/00

(52) U.S. Cl. ..... 84/452 P; 84/452 R; 84/423 R; 84/433

(58) Field of Search ..... 84/452 P, 452 R, 84/423 R, 433, 439–441

(56) References Cited

U.S. PATENT DOCUMENTS 4,840,104 A * 6/1989 Ishida et al. ..... 84/437
5,811,702 A * 9/1998 Tomizawa et al. ..... 84/254

* cited by examiner

*Primary Examiner*—Shih-Yung Hsieh
(74) *Attorney, Agent, or Firm*—Crowell & Moring LLP

(57) ABSTRACT

An action for a keyboard-based musical instrument is provided for preventing action parts made of a synthetic resin from being charged to eliminate stains due to dust and motes in the air attracted by static electricity. The action is composed of a plurality of action parts coupled to one another, including a hammer. The action actuates in response to depression on a key to swing the hammer which strikes a string. At least one of the plurality of action parts is made of a synthetic resin which has electrical conductivity at least on a surface thereof.

9 Claims, 2 Drawing Sheets

ACTION FOR KEYBOARD-BASED MUSICAL INSTRUMENT

BACKGROUND OF THE INVENTION

1. Field of the Invention

The present invention relates to an action for a keyboard-based musical instrument which actuates in response to depression on an associated key to swing a hammer which in turn strikes a string.

2. Description of the Prior Art

An action for a keyboard-based musical instrument is configured to actuate in response to depression on an associated key to swing a hammer which in turn strikes a string. An action for a grand piano is comprised of action parts which include a wippen carried on a rear portion of a key for pivotal movement about the rear end of the key; a repetition lever pivotably attached to the wippen; a jack; and the like.

As the key is depressed from a free state, the wippen is pushed up, causing the repetition lever and jack to pivotally move together upward. Associated with the pivotal movements of these parts, the jack pushes up a hammer which in turn swing upward to strike a string disposed above the hammer.

In recent years, parts made of a synthetic resin are increasingly used for the action for a keyboard-based musical instrument. This is because the parts made of synthetic resin can be worked in a higher accuracy at a lower cost, as compared with those made of wood, and hardly change in dimensions and weight with environmental changes such as humidity.

However, when the above-mentioned conventional parts made of a synthetic resin are used for an action, the motion of the action causes the action parts to rub against one another to be readily charged, resulting in the generation of static electricity. Since the synthetic resin is an insulating material, the static electricity, once generated, generally remains as it is without going away. The static electricity attracts dust, motes and the like in the air to cause stains on the action parts. Particularly, in a region where the action is accommodated, a hammer felt rubs against a string to produce motes which make the action more susceptible to stains, malfunction, reduced lifetime, and the like.

OBJECT AND SUMMARY OF THE INVENTION

The present invention has been made to solve the problem as mentioned above, and it is an object of the invention to provide an action for a keyboard-based musical instrument which is capable of preventing action parts made of a synthetic resin from being charged, thereby eliminating without fail stains due to dust and motes in the air attracted onto the action parts by the action of static electricity.

To achieve the above object, the present invention provides an action for a keyboard-based musical instrument, configured to actuate in response to depression on a key to generate sound. The action is characterized by comprising a plurality of action parts, at least one of which is made of a synthetic resin having electrical conductivity at least on a surface thereof.

This action for a keyboard-based musical instrument is configured to actuate in response to depression on a key, to swing the hammer, through the plurality of action parts, such that the hammer strikes the string. Since at least one of the plurality of action parts is made of a synthetic resin having electrical conductivity at least on a surface thereof, static electricity generated by the action parts rubbing against one another during the actuation of the action could be promptly removed, thereby preventing the action parts from being charged. This results in the prevention of the action parts from stains due to dust and motes in the air attracted by the static electricity. Consequently, the action according to the present invention can eliminate malfunctions and reduced lifetime.

Preferably, in the action for a keyboard-based musical instrument, the at least one action part is applied with an antistatic coating on the surface.

In this preferred embodiment of the action for a keyboard-based musical instrument, since the at least one action part is applied with an antistatic coating on the surface, the action parts can be prevented from being charged by removing static electricity along the electrically conductive surface. Therefore, the aforementioned effect of the present invention can be provided only by applying the antistatic coating, for example, on the surface of an ordinary synthetic resin which is not electrically conductive.

Preferably, in the action for a keyboard-based musical instrument, the at least one action part is applied with the antistatic coating by dipping.

In this preferred embodiment of the action for a keyboard-based musical instrument, since the antistatic coating is applied by dipping, the surface of the action part can be entirely coated with the antistatic coating without some portions left unpainted, unlike brushing, so that the charging can be prevented without fail. In addition, the antistatic coating can be applied more easily than with the brushing.

Preferably, in the action for a keyboard-based musical instrument, the plurality of action parts include at least one action part deposited with an electrically conductive metal on a surface thereof.

In this preferred embodiment of the action for a keyboard-based musical instrument, the charging can be prevented by the electrically conductive metal deposited on the surface of the at least one action part. In addition, since a drying step is not needed, as would be involved in applying the antistatic coating, the process required for the manufacturing can be reduced.

Preferably, in the action for a keyboard-based musical instrument, the at least one action part comprises a molding made of an electrically conductive synthetic resin.

In this preferred embodiment of the action for a keyboard-based musical instrument, since the at least one action part itself is made of the electrically conductive synthetic resin, the antistatic effect can be readily provided without the need for steps of applying an antistatic coating, depositing an electrically conductive metal, and the like after molding.

Preferably, in the action for a keyboard-based musical instrument, the at least one action part comprises a plurality of action parts coupled to each other through an electrically conductive joint, wherein at least one of the plurality of action parts coupled to each other through the joint is coupled to a grounding part.

In this preferred embodiment of the action for a keyboard-based musical instrument, since the joint between the plurality of action parts is electrically conductive, and the at least one action part is coupled to the grounding part, static electricity generated on one action part could be promptly removed to the grounding part through the joint and other action parts without fail, thereby ensuring the prevention of charged action parts.

Preferably, in the action for a keyboard-based musical instrument, the joint comprises a bushing cloth.

Generally, the action for a keyboard-based musical instrument includes a bushing cloth wound around a joint of action parts for preventing wear and noise. Therefore, according to this preferred embodiment of the action for a keyboard-based musical instrument, the existing bushing cloth can be utilized and provided with electrical conductivity to readily provide the foregoing effect of preventing the charging.

Preferably, in the action for a keyboard-based musical instrument, the bushing cloth is impregnated with an antistatic agent.

In this preferred embodiment of the action for a keyboard-based musical instrument, the electrical conductivity can be readily ensured for the bushing cloth by impregnating the bushing cloth with the antistatic agent.

Preferably, in the action for a keyboard-based musical instrument, the bushing cloth is made of an electrically conductive fiber.

In this preferred embodiment of the action for a keyboard-based musical instrument, since the bushing cloth itself is made of an electrically conductive fiber, the electrical conductivity can be ensured for the bushing cloth without the need for impregnation of antistatic agent.

DETAILED DESCRIPTION OF THE PREFERRED EMBODIMENTS

Figure 1:
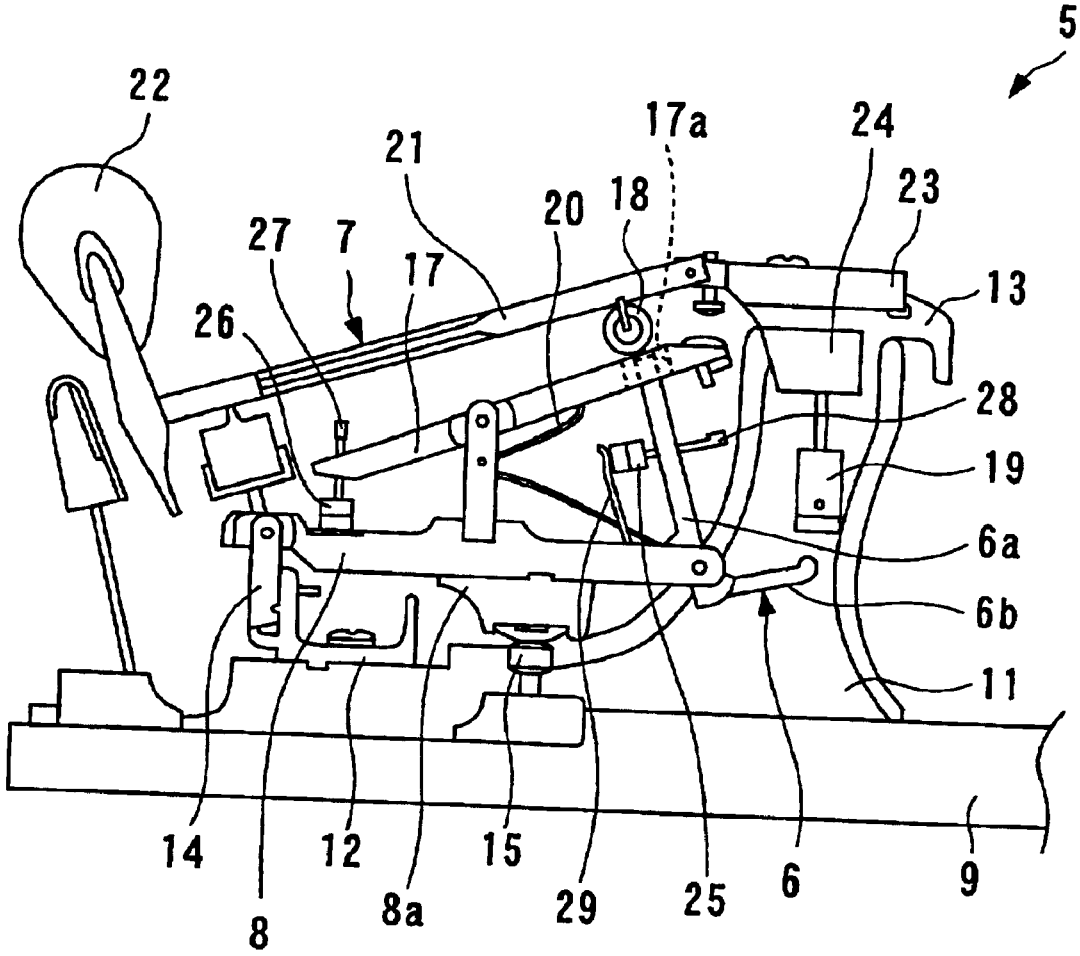
FIG. 1 is a side view of an action for use in a grand piano including a hammer and a key according to one embodiment of the present invention.
Figure 2:
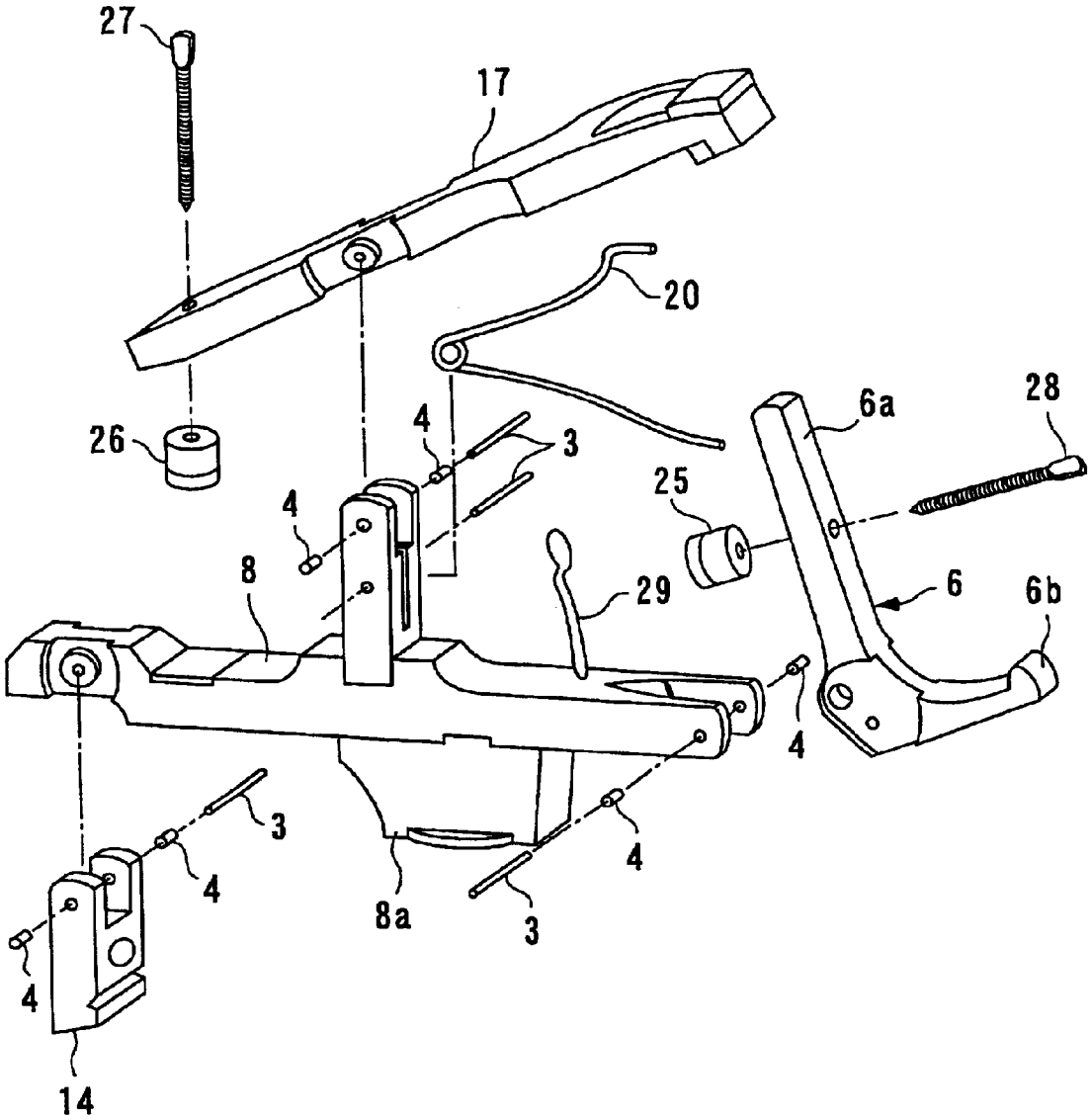
FIG. 2 is an exploded perspective view of the action illustrated in FIG. 1.

In the following, an action according to one embodiment of the present invention will be described with reference to the accompanying drawings. FIGS. 1 and 2 illustrate the action for a grand piano in the embodiment. It should be first noted that the following description is made on the assumption that the near side (on the right side in FIG. 1), viewed from a player, is the front, and the far side (on the left side in FIG. 1) is the rear.

An action 5 is provided for each key 9, and comprises action parts which include a wippen 8, a repetition lever 17, a jack 6, a hammer 7, and the like as can be seen in both figures. As illustrated in FIG. 1, the action 5 is attached to brackets 11 (only one of which is shown) disposed in left and right end portions of a keyframe (not shown) on which the key 9 is carried. A wippen rail 12 and a hammer shank rail 13, both made of aluminum extrusion moldings, extend between the left and right brackets 11. A rear end of the wippen 8 is pivotally attached to a wippen flange 14 which is screwed on the wippen rail 12. The wippen 8, which extends in the depth direction, rests on a capstan button 15 disposed at a rear portion on the top of a corresponding key 9 through a wippen heel 8*a*.

The repetition lever 17, having a rectangular shape in cross section, extends diagonally upward in the depth direction, and is pivotally attached to the wippen 8 at a central portion thereof. A lever screw 27 is movably screwed into a rear end portion of the repetition lever 17. The lever screw 27 extends through the repetition lever 17 in the vertical direction, and is integrally formed with a lever button 26 at a lower end thereof. A jack guide hole 17*a*, extending in the depth direction, is formed at a predetermined position through a front portion of the repetition lever 17 in the vertical direction. The repetition lever 17 is urged by a repetition spring 20 attached to the wippen 8 in a returning direction (in the counter-clockwise direction in FIG. 1).

The jack 6 is formed in an L-shape, and is composed of a hammer push-up rod 6*a* extending in the vertical direction and having a rectangular shape in cross section, and a regulating button abutment 6*b* extending from a lower end of the hammer push-up rod 6*a* to the rear substantially at right angles. The jack 6 is pivotably attached, at its corner, to the front end of the wippen 8. An upper end of the hammer push-up rod 6*a* is in engagement in the jack guide hole 17*a* of the repetition lever 17 for movements in the depth direction. The jack 6 is urged in a returning direction (in the counter-clockwise direction in FIG. 1) by a repetition spring 20 for urging the repetition lever 17.

A jack button screw 28 is movably screwed into an intermediate portion of the hammer push-up rod 6*a* of the jack 6 for adjusting an angular position of the jack 6. The jack button screw 28 extends through the hammer push-up rod 6*a* in the depth direction. A jack button 25 is integrally formed with a leading end of the jack button screw 28. The jack button 25 is in abutment to a spoon 29 implanted on the wippen 8 in a free state.

On the other hand, a regulating rail 24 is screwed on the bottom of the hammer shank rail 13. A regulating button 19 is movably screwed into the bottom of the regulating rail 24 for restricting upward pivotal movements of the jack 6. The regulating button 19 opposes a leading end of the regulating button abutment 6*b* of the jack 6 with a predetermined spacing therebetween.

The hammer 7, in turn, is composed of a hammer shank 21 made of wood and extending in the depth direction, and a hammer head 22 attached at a leading end of the hammer shank 21. A base end of the hammer shank 21 is pivotably attached to the hammer shank flange 23 which is fixed to the hammer shank rail 13 by screws. A shank roller 18 is formed, for example, of an inner cloth and a skin wound around the outside of the cloth in a cylindrical form, and attached at a predetermined position in a rear portion of the bottom of the hammer shank 18. The shank roller 18 is carried near the jack guide hole 17*a*, as straddling the same, on the top of the repetition lever 17.

As illustrated in FIG. 2, the wippen 8 is coupled to the wippen flange 14 by way of a movable joint centered about a fine center pin 3 made of iron. Similarly, the jack 6 is coupled to the repetition lever 17 by way of a movable joint centered about a fine center pin 3 made of iron. A bushing cloth 4 is wound around each center pin 3 for reducing friction and preventing noise when these action parts pivotally move.

According to the action 5 configured as described above, as the key 9 is depressed in the free state illustrated in FIG. 1, the wippen 8 is pushed up through the capstan button 15 to pivotally move upward, causing the repetition lever 17 and jack 6 attached to the wippen 8 to pivotally move upward together. In response, the repetition lever 17 slides the shank roller 18 and pushes up the hammer 7 through the shank roller 18 to swing the same, forcing the hammer 7 to strike a string (not shown) disposed above.

These action parts composing the action 5 are made of a synthetic resin, for example, ABS resin, except for the hammer shank made of wood and the like.

Also, in this embodiment, among these action parts made of a synthetic resin, an antistatic coating is applied on the surfaces of the wippen flange 14, wippen 8, jack 6 and repetition lever 17. This antistatic coating is made of a solution which contains an ultra-fine grain conductive metal oxide, and is applied on a base material to form a conductive thin film thereon, thereby providing an antistatic effect.

For example, when the antistatic coating is applied on the action parts made of a synthetic resin with a brush, a resulting surface resistance value is in a range of $10^8$ to $10^9$ Ω. Generally, a material such as a synthetic resin which exhibits a high electrically insulating property has a very high electric resistance in a range of $10^{15}$ to $10^{16}$ Ω, so that static electricity, once generated, accumulates on the synthetic resin without going away. It is known that dust is not attracted by static electricity when the electric resistance value is not higher than $10^{12}$ Ω. Thus, it is appreciated from the surface resistance value resulting from the antistatic coating applied on the action parts, that a sufficient antistatic effect is provided by applying the antistatic coating on the surfaces of the action parts made of synthetic resin.

Therefore, even if static electricity is generated by the action parts rubbing against one another, associated with the actuation of the action 5 caused by depression on the key 9 from a free state, the antistatic coating applied on the action parts prevents the static electricity from accumulating thereon, and lets the static electricity go away. As a result, the action parts can be prevented from being charged, thereby eliminating stains due to dust and motes in the air attracted by the static electricity.

While the antistatic coating may be applied by any known method such as spray coating, dip coating, brushing, and the like, the dip coating is preferred because it requires a less number of steps and facilities, and can properly coat the surfaces of the action parts with the antistatic coating without some parts left uncoated or unevenly coated. In this way, the action parts can be prevented from being charged without fail.

Alternatively, instead of the antistatic coating applied on the action parts, a conductive metal, for example, copper, aluminum or the like may be deposited on the surfaces of the action parts made of a synthetic resin, with the same effect produced thereby. For example, when such a conductive metal is deposited on the surfaces of the action parts, static electricity generated on any action part is allowed to go away by the action of the deposited metal, making it possible to produce completely the same effect as that provided by the applied antistatic coating. In addition, the deposition does not need drying which is required when the antistatic coating is applied, resulting in a reduction in the process.

Further alternatively, it is also possible to use an inherently electrically conductive synthetic resin to mold the action parts which provide per se the antistatic effect, rather than giving the antistatic effect to the action parts made of a synthetic resin, after molding, as is the case with the applied antistatic coating or deposited conductive metal mentioned above. The conductive synthetic resin suitable for this purpose can be, for example, a synthetic resin which contains carbon. The result of a measurement of the resistance value on the surface of a part made of this conductive synthetic resin shows a value less than $10^8$ Ω. It is appreciated from this result that action parts made of this conductive synthetic resin ensures a sufficient antistatic effect and produces completely the same effect as the antistatic coating. In addition, the conductive synthetic resin can readily provide the antistatic effect without the need for an antistatic coating applying step or a conductive metal deposition step after molding.

In addition to giving the antistatic effect to the action parts as described above, the bushing clothes 4 disposed in the joints of the wippen 8 in FIG. 2 may be impregnated with an antistatic agent. The antistatic agent for use in this event may be, for example, one which contains the same components as the aforementioned antistatic coating. The wippen rail 12 is assumed to be grounded by a proper means. In this way, even if static electricity is generated, for example, on the repetition lever 17, the static electricity flows to the wippen rail 12 made of aluminum, and to the ground through the center pin 3 made of iron in the joint of the wippen 8 with the repetition lever 17, bushing cloth 4, wippen 8, center pin 3 in the joint of the wippen 8 with the wippen flange 14, bushing cloth 4, and wippen flange 14, thereby making it possible to ensure that the static electricity is allowed to promptly go away without fail to prevent the action parts from being charged.

Alternatively, instead of the impregnated antistatic agent as described above, an inherently electrically conductive fiber may be used as the material for the bushing cloth 4 to provide the bushing cloth 4 itself with the antistatic effect. The conductive fiber for use in this event can be, for example, a fabric which contains carbon. The bushing cloth 4 made of such conductive fiber can provide substantially the same effect as the bushing cloth 4 impregnated with the antistatic agent. In addition, the conductivity can be ensured for the bushing cloth 4 without the need for a step of impregnating the bushing cloth 4 with the antistatic agent.

While in the foregoing embodiment, the antistatic effect is given to the wippen 8, repetition lever 17, jack 6 and wippen flange 14, the antistatic effect may be given to action parts made of a synthetic resin other than these parts.

Also, in the foregoing embodiment, the hammer shank 21 is not given the antistatic effect because it is made of wood. However, if the hammer shank 21 is also made of synthetic resin, the antistatic effect may be additionally given to the hammer shank 21.

Further, while the foregoing embodiment shows an example in which the present invention is applied to a grand piano, the present invention can be applied to an upright piano, an electronic piano having actions, and the like.

As will be appreciated from the foregoing, the action for a keyboard-based musical instrument according to the present invention can prevent the action parts made of a synthetic resin from being charged and thereby prevent without fail these parts from stains due to dust and motes in the air attracted by static electricity.

What is claimed is:

1. An action for a keyboard-based musical instrument, configured to actuate in response to depression on a key to swing a hammer to, in turn, generate sound, said action comprising:

a plurality of action parts operatively disposed between said key and said hammer at least one of said action parts being made of a synthetic resin having electrical conductivity at least on a surface thereof.

2. An action for a keyboard-based musical instrument according to claim 1, wherein said plurality of action parts includes at least one action part deposited with an electrically conductive metal on a surface thereof.

3. An action for a keyboard-based musical instrument according to claim 1, wherein said at least one action part comprises a molding made of an electrically conductive synthetic resin.

4. An action for a keyboard-based musical instrument configured to actuate in response to depression on a key to generate sound, said action comprising a plurality of action parts, at least one of said action parts being made of a synthetic resin having electrical conductivity at least on a surface thereof, wherein said at least one action part is applied with an antistatic coating on the surface.

5. An action for a keyboard-based musical instrument according to claim 4, wherein said at least one action part is applied with said antistatic coating by dipping.

6. An action for a keyboard-based musical instrument configured to actuate in response to depression on a key to generate sound, said action comprising a plurality of action parts, at least one of said action parts being made of a synthetic resin having electrical conductivity at least on a surface thereof, wherein said at least one action part comprises a plurality of action parts coupled to each other through an electrically conductive joint, wherein at least one of said plurality of action parts coupled to each other through said joint is coupled to a grounding part.

7. An action for a keyboard-based musical instrument according to claim 6, wherein said joint comprises a bushing cloth.

8. An action for a keyboard-based musical instrument according to claim 7, wherein said bushing cloth is impregnated with an antistatic agent.

9. An action for a keyboard-based musical instrument according to claim 7, wherein said bushing cloth is made of an electrically conductive fiber.

* * * * *